US010329126B2

(12) United States Patent
Van Den Brink

(10) Patent No.: US 10,329,126 B2
(45) Date of Patent: Jun. 25, 2019

(54) DEVICE FOR MANIPULATING FLAT OBJECTS ETC

(71) Applicant: Vacuum Lifting Holland Beheer B.V., Kootwijkerbroek (NL)

(72) Inventor: Steven Van Den Brink, Kootwijkerbroek (NL)

(73) Assignee: Vacuum Lifting Holland Beheer B.V., Kootwijkerbroek (NL)

( * ) Notice: Subject to any disclaimer, the term of this patent is extended or adjusted under 35 U.S.C. 154(b) by 0 days.

(21) Appl. No.: 15/740,712

(22) PCT Filed: Jun. 27, 2016

(86) PCT No.: PCT/NL2016/050451

§ 371 (c)(1),
(2) Date: Dec. 28, 2017

(87) PCT Pub. No.: WO2017/003282

PCT Pub. Date: Jan. 5, 2017

(65) Prior Publication Data

US 2018/0194599 A1 Jul. 12, 2018

(30) Foreign Application Priority Data

Jul. 2, 2015 (NL) ..... 1041385

(51) Int. Cl.
*B66C 1/02* (2006.01)

(52) U.S. Cl.
CPC ..... *B66C 1/0262* (2013.01); *B66C 1/0225* (2013.01); *B66C 1/0243* (2013.01); *B66C 1/0281* (2013.01)

(58) Field of Classification Search
CPC ..... B66C 1/0237; B66C 1/0243; B66C 1/025; B66C 1/0262; B66C 1/0281; B65G 47/914; B65G 47/918; B65G 49/061; B65G 49/067; B66F 9/181; B25J 15/0616
USPC ..... 294/65, 188; 414/627
See application file for complete search history.

(56) References Cited

U.S. PATENT DOCUMENTS 1,296,079 A * 3/1919 Hitchcock et al. ..... B66C 1/02 294/188
2,890,077 A * 6/1959 Littell ..... B65G 47/918 294/65
3,598,263 A * 8/1971 Ehmke ..... B65G 49/067 294/65
3,909,056 A * 9/1975 Duwe ..... B65G 49/067 294/67.22

(Continued)

FOREIGN PATENT DOCUMENTS

CN 203582258 U 5/2014
DE 4244047 A1 * 6/1994 ..... B66C 1/0212

(Continued)

*Primary Examiner* — Dean J Kramer
(74) *Attorney, Agent, or Firm* — Adler Pollock & Sheehan P.C.

(57) ABSTRACT

Device for manipulating a flat object (1), comprising a lifting hook (2) and a traverse (4) with suction cups (5), which are evacuated by a vacuum pump (6). The traverse is connected to the hook via a bearing structure (7), so that the traverse can be rotated (R) and be tilted (K). The vacuum pump tilts but does not co-rotate with the traverse and the object.

3 Claims, 2 Drawing Sheets

(56) References Cited

U.S. PATENT DOCUMENTS

Figure 2:
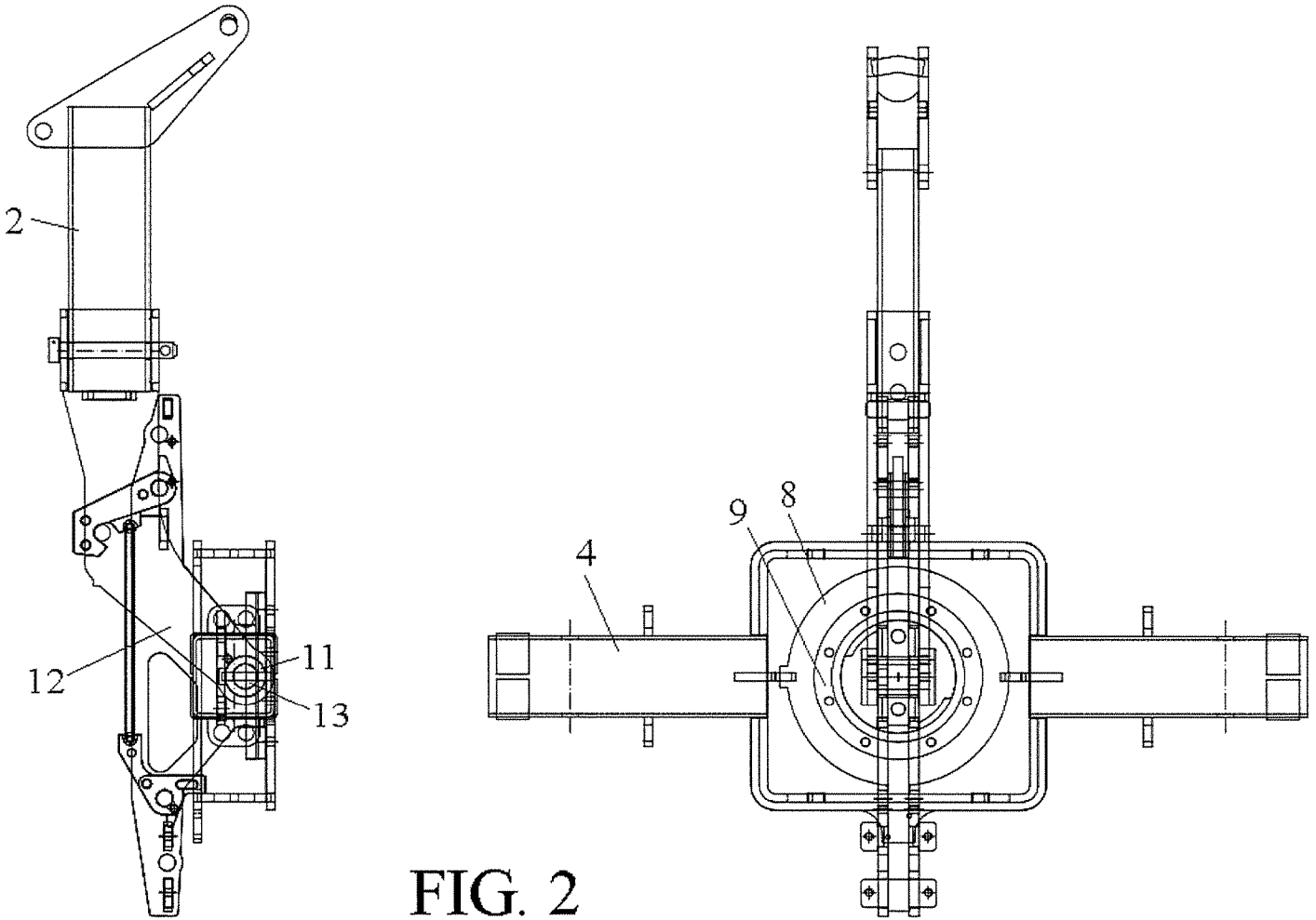

| | | | | | |
|---|---|---|---|---|---|
| 4,696,613 | A | * | 9/1987 | Hahn | B65G 49/061 212/196 |
| 4,884,938 | A | * | 12/1989 | Fujita | B65G 49/061 414/11 |
| 5,259,721 | A | * | 11/1993 | Sato | B66F 9/061 414/620 |
| 5,516,254 | A | * | 5/1996 | Gessler | B66F 9/061 414/11 |

FOREIGN PATENT DOCUMENTS

| | | | | | |
|---|---|---|---|---|---|
| EP | 2354074 | A1 | | 8/2011 | |
| FR | 2303749 | A1 | * | 10/1976 | B66C 1/0212 |
| JP | 2000 007147 | | * | 1/2000 | |

* cited by examiner

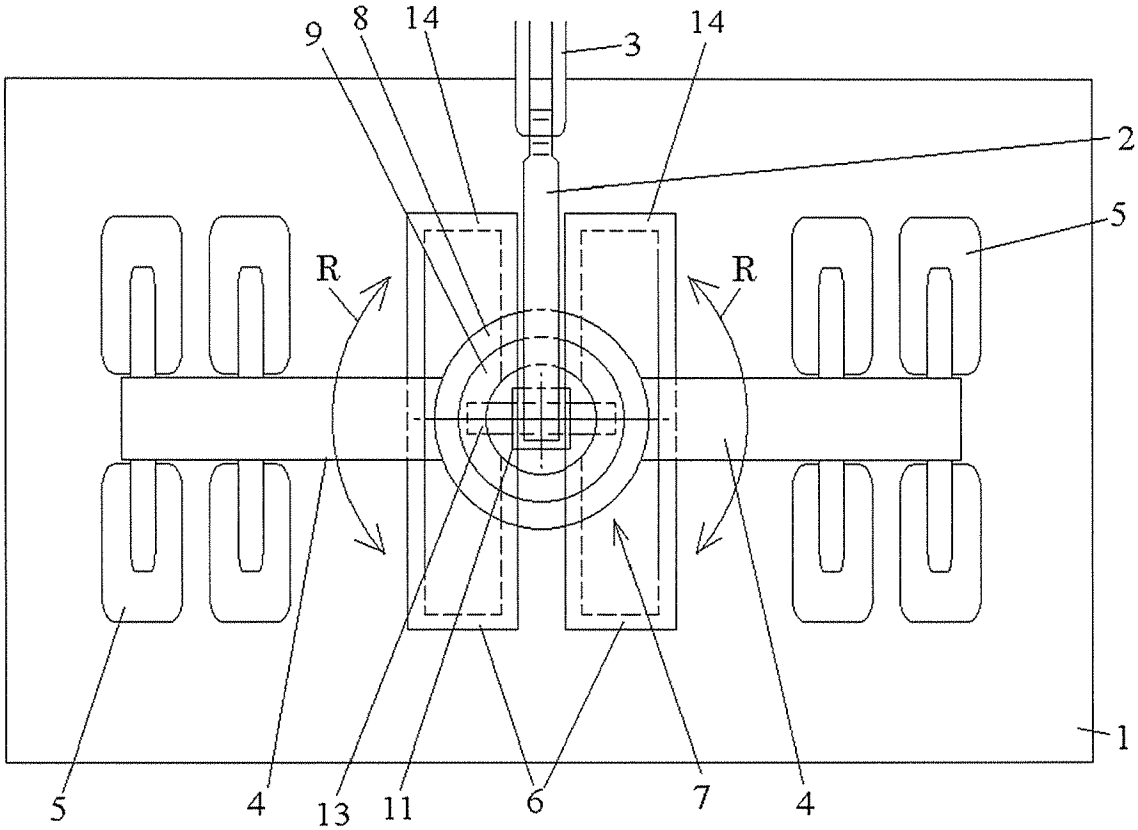
FIG. 1
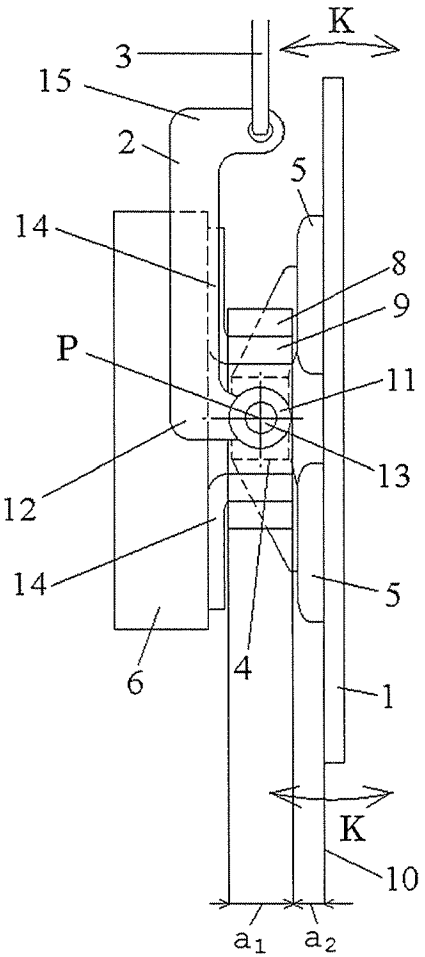

DEVICE FOR MANIPULATING FLAT OBJECTS ETC

CROSS REFERENCE TO RELATED APPLICATIONS

This application is a national phase filing under 35 U.S.C. § 371 of International Application No. PCT/NL2016/050451 filed Jun. 27, 2016, which claims priority from Netherlands application number NL1041385, filed Jul. 2, 2015, the entire contents of which is hereby incorporated by reference herein.

The invention relates to a device for manipulating flat objects, etc., for example, (large) windows, wall-covering plates, roof plates etc.

Such a device comprises a lifting hook with lifting eye, by which the device can be connected to the hoisting cable of a movable lifting device. Furthermore, the device comprises a suction cup frame, commonly referred to as traverse or crossbeam, provided with a number of suction cups, which can engage on a flat object to be moved by the device (and lifting device). The connection with the flat object is established by evacuating the suction cups by means of a vacuum pump, which is also part of the device.

The traverse is connected to the hoisting hook in such a way, via a bearing structure, that the traverse can be rotated in the plane of the object to be manipulated, but also can be tilted in the transverse direction; even in such a way that (horizontally extending) floorboards and (in a tilted plane extending) roof panels can be transported and manipulated with the device It is an object of the present invention to provide a device for manipulating flat objects, etc. having an improved manipulability and an improved reliability of the operation of the vacuum pump.

According to the invention, these objects are achieved by providing a device for manipulating flat objects, comprising a lifting hook which is adapted to be able to be connected to a hoisting device, further comprising a suction cup frame, hereinafter referred to as traverse, provided with a number of suction cups, which can engage said flat object, wherein the connection with the flat object is established by evacuating the suction cups by means of a vacuum pump, which also forms a part of the device; wherein the traverse is connected to the hoisting hook in such a way, via a bearing structure, that the traverse can be rotated in the plane of the object to be manipulated, and also can be tilted in the transverse direction, wherein the bearing structure comprises a rotary bearing and a pivot bearing, which rotary bearing comprises an outer bearing member connected with the traverse and an inner bearing member, wherein during use of the device the rotary bearing is positioned within the thickness of the traverse and/or in the space between the traverse and the surface of the object to be manipulated, and wherein the pivot bearing is connected with the lower end of said lifting hook by means of a first bearing portion, and wherein the pivot bearing is connected to said inner bearing member of the rotary bearing by means of a second bearing portion, which is tiltable relative to the first bearing portion.

Preferably, by means of a mounting frame the vacuum pump is connected to said second bearing portion of the pivot bearing and/or with said inner bearing member of the rotary bearing, in such a way that, in use of the device, the vacuum pump co-tilts with the traverse and the object to be manipulated, but does not rotate together with the traverse and the object to be manipulated. As a result of this bearing structure, because the vacuum pump does not co-rotate with the traverse and the object to be manipulated, the reliability of the vacuum pump (driven by an electric motor) is increased.

Preferably, the lower end of the lifting hook, and preferably also the upper end, is bent in the direction of the surface of the object to be manipulated, during use of the device. Due to this form, together with the special design of the bearing structure as described hereinabove, it is achieved that the pivot point of the device is close to the object to be tilted, so that the object can be tilted better and more accurately than with similar devices, which are known as prior art.

The invention will now be further discussed by means of the following figure description.

FIG. 1 schematically shows an embodiment of a device according to the invention;

FIG. 2 shows a CAD drawing of the same embodiment, in more detail.

FIGS. 1 and 2 show a device for manipulating a flat object 1, comprising a (removable) lifting hook 2, which is adapted to be able to be connected to a hoisting device, for instance by means of a sling 3. The device further comprises a suction cup frame, hereinafter referred to as traverse 4, provided with a number of suction cups 5, which can engage on the said flat object 1, wherein the connection with the flat object is established by creating a vacuum (by evacuating) the suction cups 5 by means of a vacuum pump 6 which is also part of the device.

The traverse 4 is connected to the lifting hook 2 via a bearing structure 7, in such a way, that the traverse 4 can be rotated (R) in the plane of the object 1 to be manipulated, and also can be tilted (K) in the transverse direction.

The bearing structure 7 comprises a rotary bearing and a pivot (tilting) bearing. The rotary bearing comprises an outer bearing member 8 being connected to the traverse 4, and an inner bearing member 9. This rotary bearing 8/9 is positioned within the thickness $a_1$ of the traverse 4 and/or in the space $a_2$ between the traverse 4 and the (inner) surface 10 of the object to be manipulated 1, during use of the device.

The pivot bearing is connected to the lower end 12 of the lifting hook 2 by means of a first bearing portion 11, and to the inner bearing member 9 of the rotary bearing 8/9 by means of a second (for example, shaft-like) bearing portion 13, which is tiltable with respect to the first bearing portion 11.

The vacuum pump 6 is connected to the second bearing portion 13 of the pivot bearing by means of a mounting frame 14, and/or is connected to the inner bearing member 9 of the rotary bearing 8/9, such that during use of the device the vacuum pump 6 (and the batteries) tilts (K) congruent with the traverse 4 and with the object 1 to be manipulated, but does not co-rotate (R) with the traverse 4 and the object 1 to be manipulated.

It is observed that hereinabove is assumed that the shaft-like bearing portion 13 is movably (tiltably bearingly) mounted within the first bearing portion 11 and immovably mounted onto the inner bearing member 9. Consequently, the portions 11 and 13 form the pivot bearing. In an alternative embodiment the first bearing portion 11 of the pivot bearing is provided with a shaft, which extends to both sides and which is immovably connected with (the remainder of) said first bearing portion 11. The outer ends of said shaft are movably (pivotably) mounted onto the inner bearing member 9. In that embodiment, the member 9 as shown in FIG. 1 acts as a (rotatable) inner bearing member for the rotary bearing, as well as a second bearing portion for the pivot bearing. Accordingly, the pivot bearing is formed by part 11 and part 9 (which then in fact constitutes a single part with part 13).

The lower end 12 and, preferably, also the upper end 15 of the hoisting hook 2, are bent in the direction of (the surface 10 of) the object to be manipulated 1.

Due to the rotating/tilting structure of the device, the point of engagement P is located at a short distance (in the embodiment shown, at a distance ½a1+a2) of the inner surface 10 of the object to be manipulated 1, whereby an optimum ease of manipulation is obtained. As a result, a more reliable operation of the vacuum pump 6 is obtained because this pump co-tilts (K) with the object 1, but does not co-rotate (R) with the object 1 (rotating could affect the reliability of the operation of the vacuum pump 6). After all, the vacuum pump is connected to a point of the bearing structure 7 (namely, with part 9) which can tilt but can not rotate. This is contrary to the object 1, which is connected to a point of the bearing structure 7 (namely, to part 8), which is able to tilt as much as rotate.

The invention claimed is:

1. A device for manipulating a flat object, comprising:

a lifting hook which is adapted to be able to be connected to a hoisting device, further comprising a suction cup frame, hereinafter referred to as traverse, provided with a number of suction cups, which can engage the flat object;

wherein the connection with the flat object is established by creating a vacuum in the suction cups by means of a vacuum pump, which is part of the device;

wherein the traverse is connected to the lifting hook in such a way, by means of a bearing structure, that the traverse can be rotated in the plane of the object to be manipulated, and also can be tilted in the transverse direction;

wherein the bearing structure comprises a rotary bearing and a pivot bearing, which rotary bearing comprises an outer bearing member connected to the traverse and an inner bearing member, such that the traverse has a center of rotation;

wherein the rotary bearing is positioned within the thickness of the traverse or in the space between the traverse and the surface of the object to be manipulated, during use of the device;

wherein the pivot bearing is connected with the lower end of the lifting hook by means of a first bearing portion, wherein the pivot bearing has a center;

wherein the pivot bearing is connected to or is part of the inner bearing member of the rotary bearing by means of a second bearing portion, which is tiltable relative to the first bearing portion, wherein the pivot bearing has a point of engagement with the rotary bearing;

wherein the center of the pivot bearing is positioned at the center of rotation of the traverse;

wherein the point of engagement is located inside the plane of the rotary bearing; and wherein by means of a mounting frame the vacuum pump is connected to the second bearing portion of the pivot bearing or with the inner bearing member of the rotary bearing, in such a way that, during use of the device, the vacuum pump co-tilts with the traverse and the object to be manipulated, but does not co-rotate with the traverse and the object to be manipulated.

2. The device according to claim 1, wherein the lower end of the lifting hook is bent in the direction of the surface of the object to be manipulated, during use of the device.

3. The device of claim 2, wherein the lower end of the lifting hook and the upper end of the lifting hook are bent in the direction of the surface of the object to be manipulated, during use of the device.

* * * * *